US009617062B2

(12) United States Patent
Leue

(10) Patent No.: US 9,617,062 B2
(45) Date of Patent: Apr. 11, 2017

(54) DISCHARGING DEVICE

(71) Applicant: SULZER MIXPAC AG, Haag (CH)

(72) Inventor: Percy Leue, Singen (DE)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 14/436,828

(22) PCT Filed: Aug. 20, 2013

(86) PCT No.: PCT/EP2013/067325

§ 371 (c)(1),
(2) Date: Apr. 17, 2015

(87) PCT Pub. No.: WO2014/063848

PCT Pub. Date: May 1, 2014

(65) Prior Publication Data

US 2015/0291339 A1 Oct. 15, 2015

(30) Foreign Application Priority Data

Oct. 23, 2012 (EP) ..... 12189500

(51) Int. Cl.

| | |
|---|---|
| ***B65D 81/32*** | (2006.01) |
| ***B05C 17/005*** | (2006.01) |
| ***B05C 17/01*** | (2006.01) |

(52) U.S. Cl.

CPC ..... *B65D 81/325* (2013.01); *B05C 17/00506* (2013.01); *B05C 17/00553* (2013.01); *B05C 17/00576* (2013.01); *B05C 17/0116* (2013.01); *B65D 81/3255* (2013.01)

(58) Field of Classification Search

CPC ..... B05C 17/00506; B05C 17/00553; B05C 17/00576; B05C 17/0116; B65D 81/325; B65D 81/3255

See application file for complete search history.

(56) References Cited

U.S. PATENT DOCUMENTS

| | | | | |
|---|---|---|---|---|
| 5,413,253 A * | 5/1995 | Simmen | B05C 17/00509 | 222/137 |
| 6,732,887 B2 * | 5/2004 | Bills | A61C 5/064 | 222/137 |
| 6,769,574 B1 * | 8/2004 | Keller | B05C 17/00509 | 222/137 |
| 7,383,969 B2 * | 6/2008 | Horth | A61C 5/062 | 222/145.5 |

(Continued)

*Primary Examiner* — Frederick C Nicolas
*Assistant Examiner* — Bob Zadeh
(74) *Attorney, Agent, or Firm* — Global IP Counselors, LLP

(57) ABSTRACT

A dispensing apparatus includes a storage container having an outlet flange with a component outlet which is at least partly surrounded by an inlet flange. The inlet flange is configured to adopt a closed position and a dispensing position with respect to the outlet flange. A change from the closed position into the dispensing position is carried out by a rotation of the inlet flange with respect to the outlet flange. The component outlet is arranged at a cylindrical jacket surface of the outlet flange. The first component outlet is closed by the inlet flange in the closed position of the inlet flange. In the dispensing position, a connection is established by a crossover passage between the first component outlet and a dispensing opening.

12 Claims, 2 Drawing Sheets

(56) References Cited

U.S. PATENT DOCUMENTS

2011/0198370 A1* 8/2011 Ho ..... B01F 5/0615
222/137
2015/0291339 A1* 10/2015 Leue ..... B05C 17/00506
222/136

* cited by examiner

DISCHARGING DEVICE

CROSS-REFERENCE TO RELATED APPLICATIONS

This application is a U.S. National stage application of International Application No. PCT/EP2013/067325, filed Aug. 20, 2013, which claims priority to EP Application 12189500.7 filed on Oct. 23, 2012, the contents of each of which are hereby incorporated herein by reference.

BACKGROUND

Field of the Invention

The invention relates to a dispensing apparatus for a flowable component.

Background Information

A dispensing device for two flowable components is described in EP 1 968 751 B1. The dispensing device has a storage container having a first storage chamber for a first component and having a first component outlet and has a dispensing element which is connected to the storage container and has a dispensing opening. The storage container additionally has a second storage chamber for a second component and has a second component outlet. The dispensing apparatus is designed as a static mixer in which the two components are mixed before exiting the mixer. The storage container has an outlet flange which includes a component outlet and which has a cylindrical jacket surface. The outlet flange is at least partly surrounded by an inlet flange of the dispensing element, with the inlet flange being arranged rotatable with respect to the outlet flange. The inlet flange can adopt a closed position and a dispensing position with respect to the outlet flange. The component outlets are closed in the closed position and a dispensing of the two components via the two component outlets and the dispensing opening is possible in the dispensing position. A change from the closed position into the dispensing position is carried out by a rotation of the inlet flange with respect to the outlet flange.

The component outlets are oriented in the direction of the dispensing opening and are closed in the closed position of the inlet flange by flexible closure plugs connected to the inlet flange. On a rotation of the inlet flange from the closed position into the dispensing position, the closure plugs are pulled out of the dispensing openings and in so doing are highly deformed or bent.

SUMMARY

In light of this, it is the object of the invention to propose a dispensing apparatus which can be manufactured simply and inexpensively. In accordance with the invention, this object is satisfied by a dispensing apparatus as set forth herein.

In accordance with the invention, the first component outlet is arranged at the cylindrical jacket surface of the outlet flange. In the closed position of the inlet flange, the first component outlet is closed by the inlet flange. The inlet flange thus seals the first component outlet in this position. For this purpose, the inlet flange in particular has a first section having an inner contour which corresponds to the jacket surface of the outlet flange such that in the case in which the first section is arranged above the first component outlet, the first component cannot exit the first component outlet and the first component outlet is thus closed.

The inlet flange additionally has a first crossover passage. The first crossover passage is designed and arranged so that it establishes a connection between the first component outlet and the dispensing opening in the dispensing position of the inlet flange. For this purpose, the inlet flange in particular has a second section having an inner contour which is designed so that in the case in which the second section is arranged above the first component outlet, an intermediate space which forms the crossover passage results between the first component outlet and the inlet flange. The named intermediate space is connected to the dispensing element and thus to the dispensing opening so that the first component exiting the first component outlet on the dispensing can move over the intermediate zone forming a part of the crossover passage to the dispensing element and thus to the dispensing opening.

In the dispensing apparatus in accordance with the invention, no flexible closure plug is necessary to close the first component outlet. Such closure plugs are only complex and thus expensive in manufacture.

In addition, the dispensing apparatus in accordance with the invention can be filled particularly easily without air being trapped. The inlet flange can be brought into the dispensing position on the filling of the storage chamber. Air which is trapped on the filling of the first component can thus escape via the dispensing opening. As soon as the filling has been completed, the inlet flange can be brought into the closed position and the first storage chamber can thus be closed.

Furthermore, the dispensing apparatus only has a particularly small loss volume. The loss volume is to be understood as the quantity of the first component which cannot be dispensed from the dispensing apparatus and thus remains unused in the dispensing apparatus. The total volume of a closure plug is part of the loss volume. Since no closure plug is necessary with the dispensing apparatus in accordance with the invention, the loss volume is correspondingly smaller.

The outlet flange can be designed so that it only has a throughgoing cylindrical jacket surface with a constant diameter over its total axial extent. It is, however, also possible that the outlet flange has a plurality of cylindrical jacket surfaces with different diameters or also only has a section with a cylindrical jacket surface at which the first component outlet is arranged.

The dispensing element can in particular be designed as a straight tube or as a curved tube whose open end disposed opposite the inlet flange forms the dispensing opening. The inlet flange and the dispensing element are in particular designed as one component which is manufactured by means of an injection molding process.

The storage container and the outlet flange are in particular designed as one component, for example of plastic, which is manufactured by means of an injection molding process. The first storage chamber in particular has a hollow cylindrical inner contour in which a first piston is arranged which can be displaced in the direction of a first component outlet, and thus in the direction of a dispensing direction, for dispensing the first component. The first piston can, for example, be displaced by hand via an actuation rod. In this case, the dispensing apparatus is designed as a syringe. It is, however, also possible that the dispensing apparatus is designed as a so-called cartridge which is used for displacing the first piston into a dispensing device. It is likewise possible that the storage chamber is designed as a so-called pillow bag which is compressed or rolled up for dispensing the first component.

Corresponding markings can be provided at the inlet flange and at the outlet flange or at the storage container for marking the closed position and the dispensing position of the inlet flange with respect to the outlet flange.

It is generally possible that the inlet flange can be rotated out of the closed position in both directions with respect to the outlet flange. It is, however, also possible that only a rotation in one direction is possible. In addition, a security against turning back can be provided so that a rotation into the closed position is no longer possible after adjusting the dispensing position. It can thus be ensured that the dispensing apparatus can only be used one single time.

The dispensing apparatus in accordance with the invention has been used, for example, in the dental sector or for adhesives.

In an embodiment of the invention, the outlet flange has a peripheral abutment surface which is aligned in the direction of the dispensing opening, that is in the dispensing direction. The dispensing opening is designed so that a counter-surface of the inlet flange also abuts the abutment surface in the total region of the crossover passage. The crossover passage is thus bounded by the abutment surface against the dispensing direction with respect to the outlet flange in the dispensing position of the inlet flange so that a flowing of the first component against the dispensing direction is prevented.

In an embodiment of the invention, the outlet flange has a peripheral collar which forms a latch connection between the outlet flange and the inlet flange with a corresponding groove in the inlet flange. A particularly simple and inexpensive connection is thus possible between the outlet flange and the inlet flange and thus between the dispensing element and the storage container.

In an embodiment of the invention, the abutment surface bounds the collar in the direction of the dispensing opening, that is in the dispensing direction. It is thus not possible, or is only possible while exerting a very strong force, to plug the dispensing element too far onto the storage container. A correct plugging of the dispensing element onto the storage container and thus a correct assembly of the dispensing apparatus can thus be ensured.

In an embodiment of the invention, the storage container has a second storage chamber for a second component and a second component outlet which is likewise arranged at the jacket surface of the outlet flange. In the closed position of the inlet flange, the second component outlet is also closed by the inlet flange. The inlet flange has a second crossover passage which is designed and arranged so that it establishes a connection between the second component outlet and the dispensing element in the dispensing position of the inlet flange. The dispensing element is designed as a mixer having a mixer housing and a mixing element arranged within the mixer housing, with the inlet flange being designed as a part of the mixer housing.

The dispensing apparatus can thus be used for dispensing and mixing two different flowable components which, for example, harden after the mixing.

It is also possible that the storage container has a third, and optionally further, storage chambers and thus three or more components can be dispensed and mixed.

The mixing element can in particular be designed in one piece with the outlet flange. The dispensing apparatus is thus composed of a particularly small number of individual parts so that the manufacture of the dispensing apparatus is particularly inexpensive.

In this case, the arrangement of the component outlets at the jacket surface of the outlet flange also has technical production advantages on the manufacture by means of an injection molding process. So-called cores are required for forming the component outlets, said cores having to be pulled out again to end an injection molding process. If the component outlets were oriented in the direction of the dispensing opening, the mixing element, which is likewise oriented in the direction of the dispensing opening, can be in the way on the pulling off of the cores.

In an embodiment of the invention, the first component outlet and the second component outlet are oriented in opposite directions. A first exit direction of the first component from the first component outlet and a second exit direction of the second component from the second component outlet thus have opposite directions and include an angle of 180°. It is thus effectively avoided that a contact can take place between the two components, that is a so-called cross-contamination can take place, before the mixing element is reached.

If more than two components are to be dispensed, the component outlets are in particular oriented such that the same angle is respectively produced between two adjacent exit directions. That is an angle of 120° with three components and an angle of 90° with four components.

Other angles are, however, also possible between adjacent outlet directions.

In an embodiment of the invention, a rotation of the inlet flange by 90° with respect to the outlet flange is necessary for the change from the closed position into the dispensing position with an opposite orientation of the component outlets. A maximum spacing between the component outlets and the crossover passages, and thus a maximum sealing area for the component outlets, thus results in the closed position. An unwanted exit of one of the two components can thus be effectively avoided in the closed position of the inlet flange.

In an embodiment of the invention, the mixer is designed as a static mixer. The mixer thus has a fixed-position mixing element. The mixer and thus the entire dispensing apparatus can thus be manufactured particularly inexpensively. The outlet flange and the mixing element can in this respect be designed as a single component or as separate components. For cost reasons, an attempt is usually made to keep the number of individual components of a dispensing apparatus as small as possible so that the outlet flange and the mixing element would be designed as one component. In individual cases, however, it may also be sensible to design the outlet flange and the mixing element as separate components. This can be the case, for example, when the mixing element is designed as very small and sensitive and if damage to the mixing element could occur on the manufacture of the two elements as a single component.

In an embodiment of the invention, the outlet flange and the mixing element are designed as separate components and the outlet flange has a cut-out in the direction of the dispensing opening into which an end region of the mixing element dips. The cut-out of the outlet flange and the end region of the mixing element are in particular designed so that the end region of the mixing element can only dip into the cut-out in a defined position. A secure support of the mixing element with respect to the outlet flange is thus ensured, on the one hand, and it is also ensured that the mixing element always has the same positioning with respect to the outlet flange. It is thus ensured that flow of the components onto the mixing element always takes place from a desired predefined direction. An ideal and reproducible mixing of the components is thus always made possible.

The end region of the mixing element and thus also the cut-out can, for example, have an oval or a rectangular contour. In this case, the mixing element can be positioned into two different locations with respect to the outlet flange. To ensure only exactly one location, the end region and the cut-out can also have a pentagonal contour, for example, which is composed of a rectangle and a triangle.

Further advantages, features and details of the invention result with reference to the following description of embodiments and with reference to drawings in which elements which are the same or have the same function are provided with identical reference numerals.

BRIEF DESCRIPTION OF THE DRAWINGS

Referring now to the attached drawings which form a part of this original disclosure.

DETAILED DESCRIPTION OF EMBODIMENTS

Figure 1:
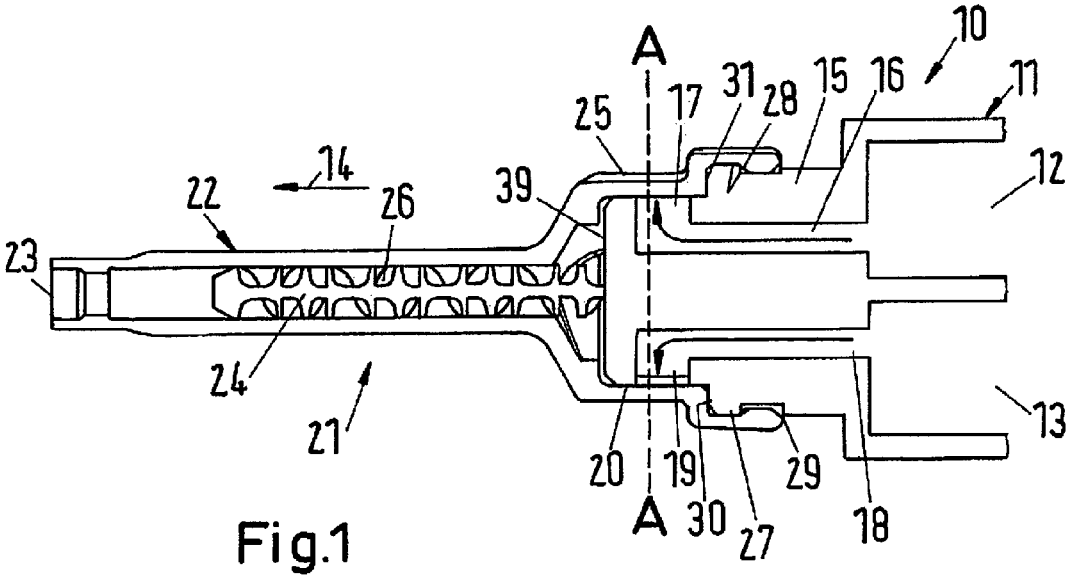
FIG. 1 illustrates a dispensing apparatus in which an inlet flange adopts a closed position with respect to an outlet flange.

In accordance with FIG. 1, a dispensing apparatus 10 has a storage container 11 for two flowable components. The storage container 11 has a first storage chamber 12 for a first component and a second storage chamber 13 for a second component, with the storage chambers 12, 13 only being shown in part. The storage chambers 12, 13 have a hollow cylindrical inner contour and are arranged in parallel to one another and in parallel to a dispensing direction 14. The storage container 11 has an outlet flange 15 which bounds the two storage chambers 12, 13 in the dispensing direction 14 and has a first connection passage 16 from the first storage chamber 12 to a first component outlet 17 and has a second connection passage 18 from the second storage chamber 13 to a second component outlet 19. A respective piston, not shown, which is displaceable in the dispensing direction 14 and by means of which the two components can be urged out of the storage chambers 12, 13 to their respective component outlet 17, 19, is arranged in the storage chambers 12, 13.

The outlet flange 15 sectionally has cylindrical jacket surfaces of different diameters in the dispensing direction 14. The first component outlet 17 and the second component outlet 19 are arranged at a last jacket surface 20 of the outlet flange 15 with respect to the dispensing direction 14, with the first and second component outlets 17, 19 being oriented in opposite directions. The connection passages 16, 18 do not have an opening in the dispensing direction 14.

The dispensing apparatus 10 also has a dispensing element in the form of a static mixer 21 having a mixer housing 22 which has a dispensing opening 23 open in the dispensing direction 14. The mixer housing 22 has a tubular part 24 and an inlet flange 25 adjacent to it against the dispensing direction 14. A static mixing element 26 by which a good mixing is made possible on a dispensing of the components is arranged within the tubular part 24. The mixer 21 is connected by means of the inlet flange 25 to the outlet flange 15 and thus to the storage container 11. The inlet flange 25 for this purpose regionally has an inner contour corresponding to the outer contour of the outlet flange 15.

The outlet flange 15 has a peripheral collar 27, that is a region extending in the dispensing direction 14 and having a larger outer diameter with respect to the adjacent regions, between the storage chambers 12, 13 and the component outlets 17, 19. The inlet flange 25 has a groove 28 corresponding to it so that a latch connection is thus formed between the outlet flange 15 and the inlet flange 25. On the pushing of the inlet flange 25 onto the outlet flange 15, the collar 27 latches into the groove 28, whereby a secure connection is established between the inlet flange 25 and the outlet flange 15 and thus between the mixer 21 and the storage container 11. The inlet flange 25 has an introduction chamber, which is not shown in any more detail, at the inner side at its margin opposite the dispensing opening 23 and which simplifies the overcoming of the collar 27. For the same purpose, the collar 27 has a corresponding chamfer, likewise not shown in any more detail, at its edge oriented in the direction of the dispensing opening 23.

The collar 27 is bounded in the direction of the dispensing opening 23 by an abutment surface 30 at which a counter-surface 31 of the inlet flange 25 abuts. The abutment surface 30 is designed so that the counter-surface 31 of the inlet flange 25 cannot overcome the abutment surface 30 of the outlet flange 15, or can only overcome it with an extremely high exertion of force.

Figure 2:
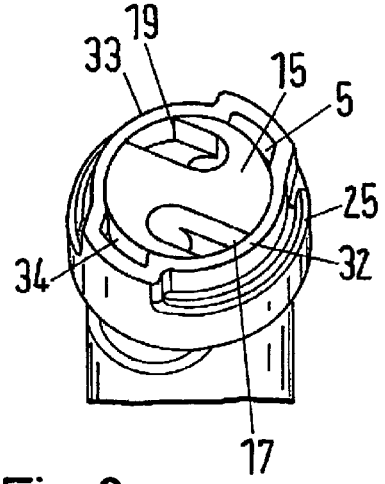
FIG. 2 is a plan view of a section along the line A-A in FIG. 1.

The inlet flange 27 has an inner contour, which has no circular cross-sections, in a region from the counter-surface 31 in the direction of the dispensing opening 23. This inner contour can be seen in FIG. 2 which shows a plan view of a section along the line A-A in FIG. 1. In addition to two oppositely disposed closure segments 32, 33 having an inner contour which corresponds to the outer contour of the outlet flange 15, the inner contour of the inlet flange 25 has a first crossover passage 34 and a second crossover passage 35 disposed opposite the first crossover passage 34. To form the two crossover passages 34 and 35, the inner contour of the inlet flange 25 has a larger diameter with respect to the outer contour of the outlet flange 15 so that a respective intermediate space results between the outlet flange 25 and the inlet flange 15, each intermediate space forming the crossover passages 34, 35. The crossover passages 34, 35 extend up to an end 36 of the outlet flange 15 which is oriented in the direction of the dispensing opening 23 and are thus connected to the dispensing opening 23 via the tubular part 24 of the mixer 21.

The inlet flange 25 can be rotated with respect to the outlet flange 15. In a closed position of the inlet flange 25 shown in FIGS. 1 and 2, the closure segments 32, 33 are arranged in the region of the first and second component outlets 17 and 19 are thus prevent an exit of the components from the component outlets 17 and 19. In the closed position of the inlet flange 35, the first and second component outlets 17, 19 are closed by the inlet flange 25. The first and second crossover passages 34 and 35 are arranged in the closed position at a respective angle of 90° to the component outlets 17 and 19.

Figure 3:
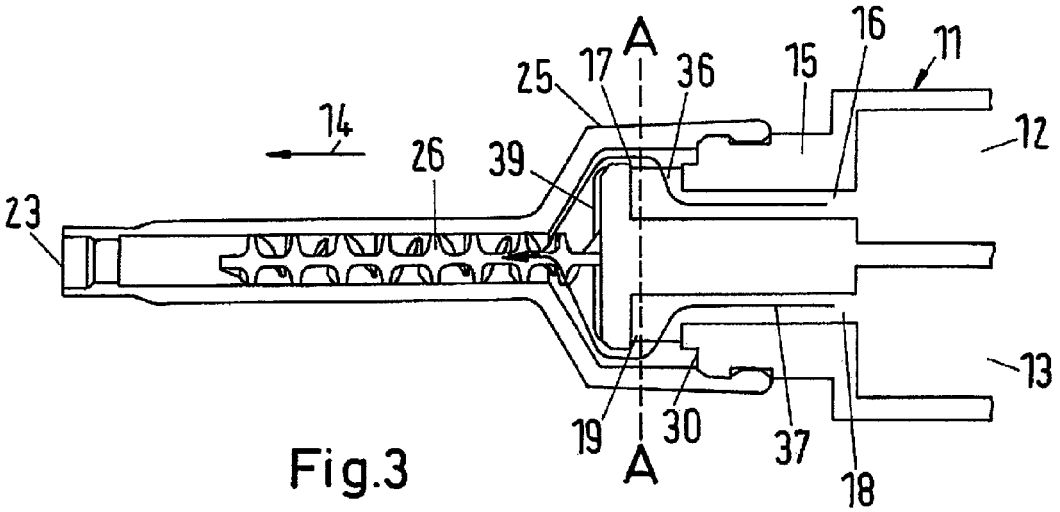
FIG. 3 illustrates a dispensing apparatus in which an inlet flange adopts a dispensing position with respect to an outlet flange.
Figure 4:
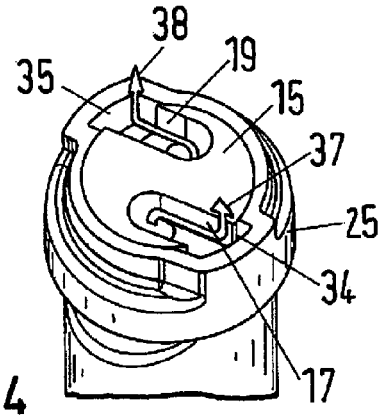
FIG. 4 is a plan view of a section along the line A-A in FIG. 3.
Figure 5:
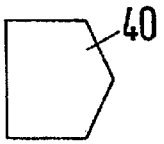
FIG. 5 illustrates a cut-out in an outlet flange of the dispensing device into which an end region of a mixing element of the dispensing apparatus can dip.

The inlet flange 25 can be brought into a dispensing position shown in FIGS. 3 and 4 by a rotation of the inlet flange 25 by 90° with respect to the outlet flange 15. In the dispensing position, the first crossover passage 34 is arranged at the first component outlet 17 and the second crossover passage 35 is arranged at the second component outlet 19. The first component can thus be urged out of the first storage chamber 12 via the first connection passage 16, via the first component outlet 17 and via the first crossover passage 34 to the mixing element 26 and the second component can thus be urged out of the second storage chamber 13 via the second connection passage 18, via the second component outlet 19 and via the second crossover passage 35 to the mixing element 26, as symbolized by the arrows 37 and 38, by a displacement of the pistons arranged in the storage chambers 12 and 13 in the dispensing direction 14, said first and second components respectively being mixed at said mixing element and being dispensed via the dispensing opening 23.

As shown in FIG. 3, the abutment surface 30 of the outlet flange 15 is designed so that the counter-surface 31 of the inlet flange 25 also abuts the abutment surface 30 in the entire region of the crossover passages 34, 35. The first and second components can thus only flow from the component outlets 17, 19 in the dispensing position of the inlet flange 15 in the dispensing direction 14 and not against the dispensing direction 14.

The mixing element 26 and the storage container 11 are designed as separate components in this embodiment. To fix and position the mixing element 26 with respect to the outlet flange 15, the latter has a cut-out 40 at its end 36 which is only shown in FIG. 3 and into which an end region 39 of the mixing element 26 can dip. So that the mixing element 26 is always correctly positioned with respect to the outlet flange, the cut-out 40 has a polygonal form which is composed of a rectangle and a triangle. The end region 39 of the mixing element 26 has a corresponding outer contour so that the mixing element 26 can only be plugged into the cut-out 40 in exactly one position.

The mixing element and the outlet flange and thus the storage container can also be designed as only one single component.

The invention claimed is:

1. A dispensing apparatus for a flowable component, the dispensing apparatus comprising:

a storage container having a first storage chamber configured to hold a first component and having a first component outlet; and a dispensing element connected to the storage container and having a dispensing opening, the storage container having an outlet flange, the outlet flange comprising the first component outlet and a cylindrical jacket surface at least partly surrounded by an inlet flange of the dispensing element, the inlet flange being rotatable with respect to the outlet flange, and the inlet flange being configured to adopt a closed position with respect to the outlet flange, in the closed position, the first component outlet being closed, and the inlet flange being configured to adopt a dispensing position, in the dispensing position, the first component outlet being configured to dispense the first component via the dispensing opening, and the inlet flange being configured to change from the closed position into the dispensing position by a rotation of the inlet flange with respect to the outlet flange, the first component outlet being formed within the cylindrical jacket surface of the outlet flange, the first component outlet being closed by the inlet flange in the closed position of the inlet flange, and an inner contour of the inlet flange having a first crossover passage configured and arranged such that the first crossover passage establishes a connection between the first component outlet and the dispensing opening in the dispensing position of the inlet flange by being a part of a flow path of the first component between the first component outlet and the dispensing opening.

2. The dispensing apparatus in accordance with claim 1, wherein the outlet flange has a peripheral abutment surface, the peripheral abutment surface being aligned in the direction of the dispensing opening and configured such that a counter-surface of the inlet flange abuts the abutment surface in an entire region of the crossover passage.

3. The dispensing apparatus in accordance with claim 2, wherein the abutment surface bounds the collar in the direction of the dispensing opening.

4. The dispensing apparatus in accordance with claim 1, wherein the outlet flange has a peripheral collar, the peripheral collar forming a latch connection between the outlet flange and the inlet flange with a corresponding groove in the inlet flange.

5. The dispensing apparatus in accordance with claim 1, wherein the storage container has a second storage chamber configured to hold a second component and has a second component outlet disposed at the jacket surface of the outlet flange, the second component outlet is closed by the inlet flange in the closed position of the inlet flange, an inner contour of the inlet flange has a second crossover passage, the second crossover passage being configured and arranged so as to establish a connection between the second component outlet and the dispensing opening in the dispensing position of the inlet flange, and the dispensing element is a mixer having a mixer housing and a mixing element disposed within the mixer housing, with the inlet flange being a part of the mixer housing.

6. The dispensing apparatus in accordance with claim 5, wherein the mixing element and the outlet flange are one piece.

7. The dispensing apparatus in accordance with claim 5, wherein the first and the second component outlets are oriented in opposite directions.

8. The dispensing apparatus in accordance with claim 7, wherein the inlet flange is configured to rotate 90° with respect to the outlet flange to change the closed position into the dispensing position.

9. The dispensing apparatus in accordance with claim 5, wherein the mixer is a static mixer.

10. The dispensing apparatus in accordance with claim 9, wherein the outlet flange and the mixing element are separate components and the outlet flange has a cut-out in the direction of the dispensing opening into which an end region of the mixing element is configured to dip.

11. The dispensing apparatus in accordance with claim 10, wherein the cut-out of the outlet flange and the end region of the mixing element are configured such that the end region of the mixing element only dips into the cut-out in a defined position.

12. A dispensing apparatus for a flowable component, the dispensing apparatus comprising:

a storage container having a first storage chamber configured to hold a first component and having a first component outlet; and a dispensing element connected to the storage container and having a dispensing opening, the storage container having an outlet flange, the outlet flange encompassing the first component outlet and having a cylindrical jacket surface at least partly surrounded by an inlet flange of the dispensing element, the inlet flange being rotatable with respect to the outlet flange, and the inlet flange being configured to adopt a closed position with respect to the outlet flange, in the closed position, the first component outlet being closed, and the inlet flange being configured to adopt a dispensing position, in the dispensing position, the first component outlet being configured to dispense the first component via the dispensing opening, and the inlet flange being configured to change from the closed position into the dispensing position by a rotation of the inlet flange with respect to the outlet flange, the first component outlet being disposed at the cylindrical jacket surface of the outlet flange, the first component outlet being closed by the inlet flange in the closed position of the inlet flange, and an inner contour of the inlet flange having a first crossover passage configured and arranged so as to establish a connection between the first component outlet and the dispensing opening in the dispensing position of the inlet flange, the storage container having a second storage chamber configured to hold a second component and has a second component outlet disposed at the jacket surface of the outlet flange, the second component outlet being closed by the inlet flange in the closed position of the inlet flange, an inner contour of the inlet flange having a second crossover passage, the second crossover passage being configured and arranged so as to establish a connection between the second component outlet and the dispensing opening in the dispensing position of the inlet flange, and the dispensing element being a mixer having a mixer housing and a mixing element disposed within the mixer housing, with the inlet flange being a part of the mixer housing.

* * * * *